US008100475B2

(12) United States Patent
Habing

(10) Patent No.: US 8,100,475 B2
(45) Date of Patent: Jan. 24, 2012

(54) ROCKER LOUNGE

(76) Inventor: Theodore G. Habing, Tustin, CA (US)

( * ) Notice: Subject to any disclaimer, the term of this patent is extended or adjusted under 35 U.S.C. 154(b) by 0 days.

(21) Appl. No.: 12/542,610

(22) Filed: Aug. 17, 2009

(65) Prior Publication Data

US 2009/0302650 A1 Dec. 10, 2009

Related U.S. Application Data

(63) Continuation of application No. 11/716,144, filed on Mar. 9, 2007, now Pat. No. 7,575,277.

(51) Int. Cl.
*A47C 3/02* (2006.01)

(52) U.S. Cl. ..... 297/260.1; 297/260.3; 297/270.5

(58) Field of Classification Search ..... 297/260.1, 297/260.3, 270.1, 270.5
See application file for complete search history.

(56) References Cited

U.S. PATENT DOCUMENTS

| | | | |
|---|---|---|---|
| 265,266 | A | 10/1882 | Lang |
| 277,617 | A | 5/1883 | Schneider |
| 667,085 | A | 1/1901 | Grader |
| 676,383 | A | 6/1901 | Goodman |
| 702,331 | A | 6/1902 | Roberts |
| 918,737 | A | 4/1909 | Curtiss |
| 920,298 | A | 5/1909 | Evans |
| 932,235 | A | 8/1909 | Alp |
| 959,949 | A | 5/1910 | Leipert |
| 1,011,728 | A | 12/1911 | Boyd |
| 1,241,277 | A | 9/1917 | Prostredny |
| 1,754,703 | A | 4/1930 | Swindler |
| 2,434,058 | A | 1/1948 | Stenzel |
| 2,562,745 | A | 7/1951 | Sebel |
| 2,651,058 | A | 9/1953 | Almoslino |
| 2,793,375 | A | 5/1957 | Wardell, Jr. |
| 3,195,951 | A | 7/1965 | Palmer |
| 3,774,961 | A | 11/1973 | Lecarpentier |
| 4,141,588 | A | 2/1979 | Anderson |
| 4,534,591 | A | 8/1985 | Parker |
| 4,576,374 | A | 3/1986 | Thomas |
| 5,466,191 | A | 11/1995 | Chang |
| 7,276,033 | B2 | 10/2007 | Phillips |
| 2006/0035769 | A1 | 2/2006 | Phillips |

OTHER PUBLICATIONS

Dream Visions, LLC, Chinese Office Action mailed Aug. 13, 2010, CN Application No. 200810085239.8, with English-language translation.

*Primary Examiner* — Anthony D Barfield
(74) *Attorney, Agent, or Firm* — Blakely Sokoloff Taylor & Zafman LLP

(57) ABSTRACT

A lounge has a foot-operated mechanism for propelling the lounge with a rocking motion. The lounge has a frame with at least one arcuate runner contacting the floor. A user-supporting surface is attached to the frame with portions of the surface adapted to support different body regions of the user, particular the body regions proximate to the user's knees, neck and buttocks. The user-supporting surface may be configured so that the user's buttocks are at a lower elevation than the user's knees and neck. A foot pedal is connected by a linkage assembly to an actuating member that contacts the ground. By pushing against the pedal, the user can impart a rocking motion to the lounge. The lounge may be folded along portions of the frame for compact, convenient storage.

5 Claims, 12 Drawing Sheets

ROCKER LOUNGE

CROSS-REFERENCE TO RELATED APPLICATION

This is a continuation of application Ser. No. 11/716,144, filed Mar. 9, 2007 now U.S. Pat. No. 7,575,277.

BACKGROUND OF THE INVENTION

1. Field of the Invention

The present invention relates generally to the field of casual furniture and, more particularly, to a lounge chair that provides a rocking motion.

2. Background

Rocking chairs and gliders are popular types of leisure furniture. Many different designs for such devices have been proposed over the years. In most of the devices, the rocking motion is provided by the user pushing his or her feet against the floor. Lounges are another type of popular casual furniture that allow the user to recline, usually at an adjustable angle. It is difficult to combine the appealing characteristics of a rocking chair and a lounge. Primarily, this is due to the fact that a person reclining in a lounge is unable to comfortably push his or her feet against the floor.

SUMMARY OF THE INVENTION

The present invention provides a rocker lounge with a foot-operated mechanism for propelling the lounge with a rocking motion. The lounge has a frame with at least one arcuate runner contacting the floor. A user-supporting surface is attached to the frame with portions of the surface adapted to support different body regions of the user, particular the body regions proximate to the user's knees, neck and buttocks. The user-supporting surface may be configured so that the user's buttocks are at a lower elevation than the user's knees and neck. A foot pedal is connected by a linkage assembly to an actuating member that contacts the ground. By pushing against the pedal, the user can impart a rocking motion to the lounge. The lounge may be folded along portions of the frame for compact, convenient storage.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
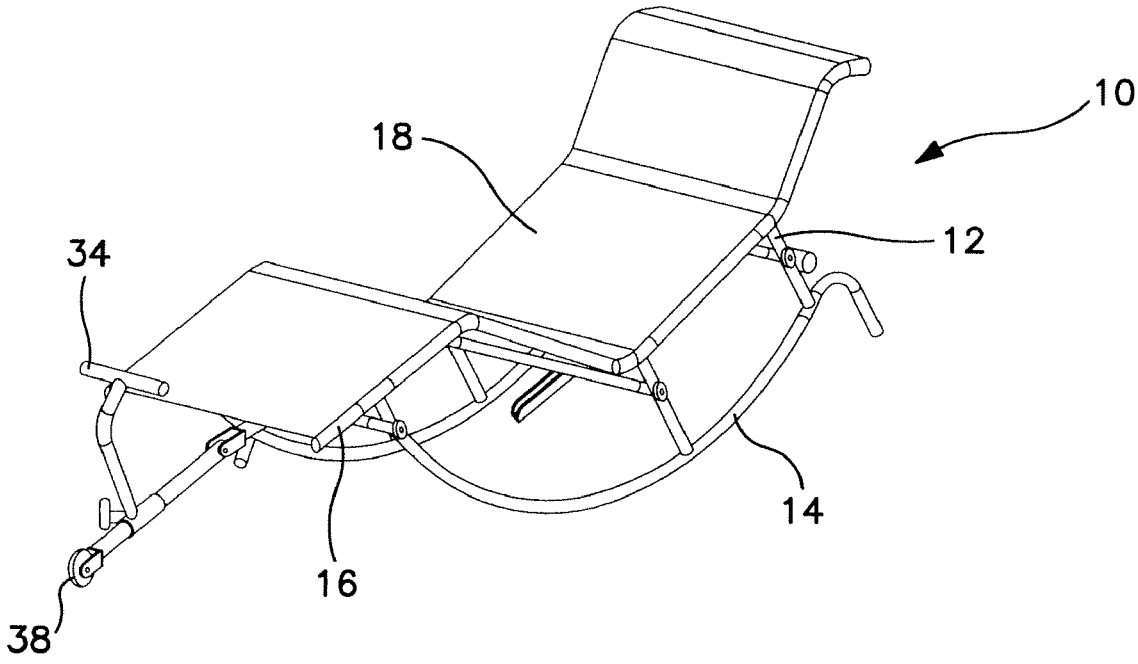
FIG. 1 is a front perspective view of a lounge in accordance with one embodiment of the present invention.
Figure 2:
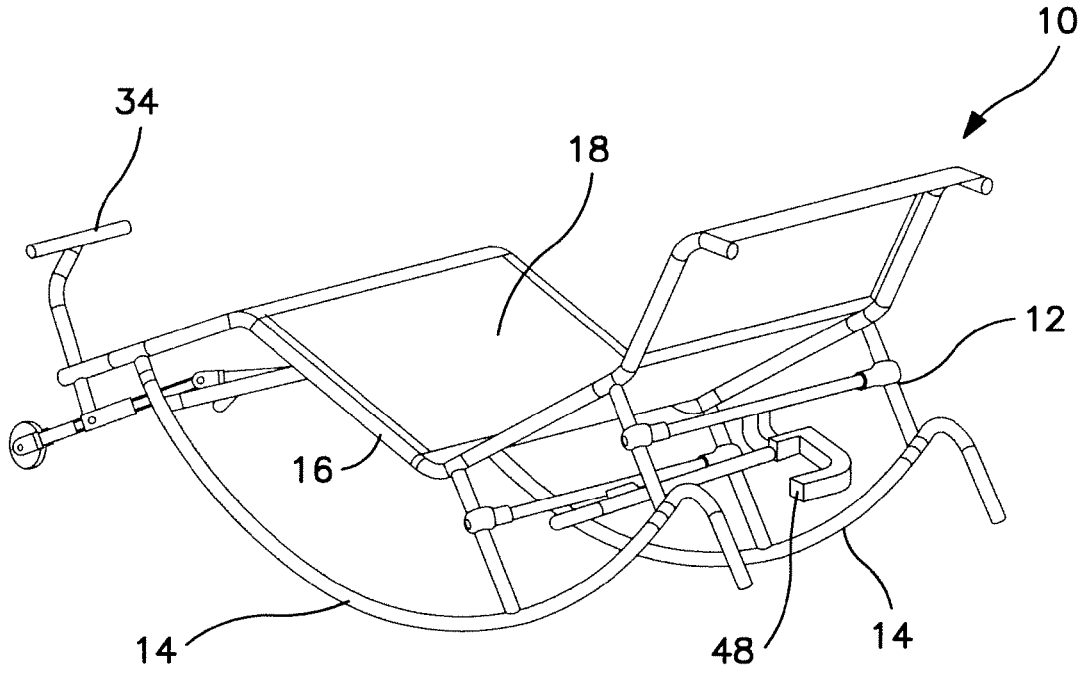
FIG. 2 is a rear perspective view of the lounge shown in FIG. 1.
Figure 3:
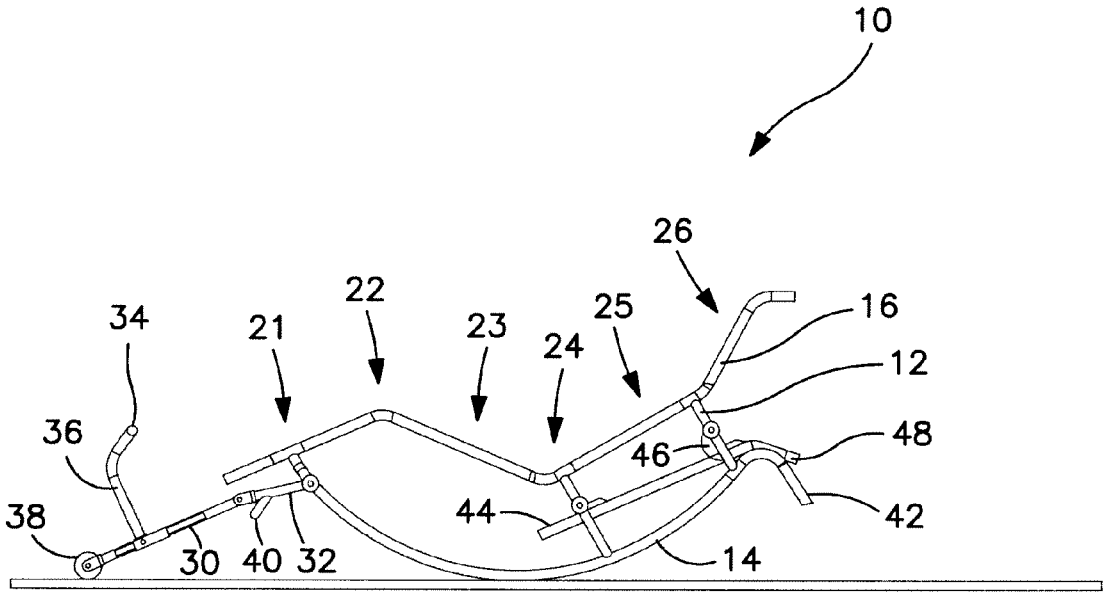
FIG. 3 is a side elevation view of the lounge shown in FIG. 1.

Referring to FIGS. 1-3, a lounge 10 is shown in accordance with one embodiment of the present invention. Lounge 10 includes a frame shown generally as 12 that includes a pair of arcuate runners 14 that rest on the floor or other supporting surface. Frame 12 also includes a pair of side rails 16, to which is attached a user-supporting surface 18. The side rails 16 are bent so that the user-supporting surface is divided into several portions for supporting the various parts of the user's body. Thus, portion 21 supports the user's lower legs, portion 22 supports the user's knees, portion 23 supports the user's upper legs, portion 24 supports the user's buttocks, portion 25 supports the user's torso and portion 26 supports the user's head and neck.

Frame 12 and the other structural components of lounge 10 may be constructed of any suitable material, such as aluminum, steel or plastic tubing. The user-supporting surface 18 may be any suitable fabric material, such as canvas or nylon. In other embodiments, frame 12 and/or user-supporting surface 18 may be fabricated of wood.

Arm member 30 is pivotally attached at the foot end of lounge 10 to frame extension member 32. Foot pedal 34 is attached to pedal support 36, which, in turn, is attached to arm member 30. Pedal support 36 is slidably adjustable along the length of arm member 30. Wheel 38 is rotatably attached to the end of arm member 30 for rolling contact with the floor or other supporting surface. As the user reclines on supporting surface 18, the user can impart a rocking motion to the lounge by simply pressing his or her feet against pedal 34.

Figure 4:
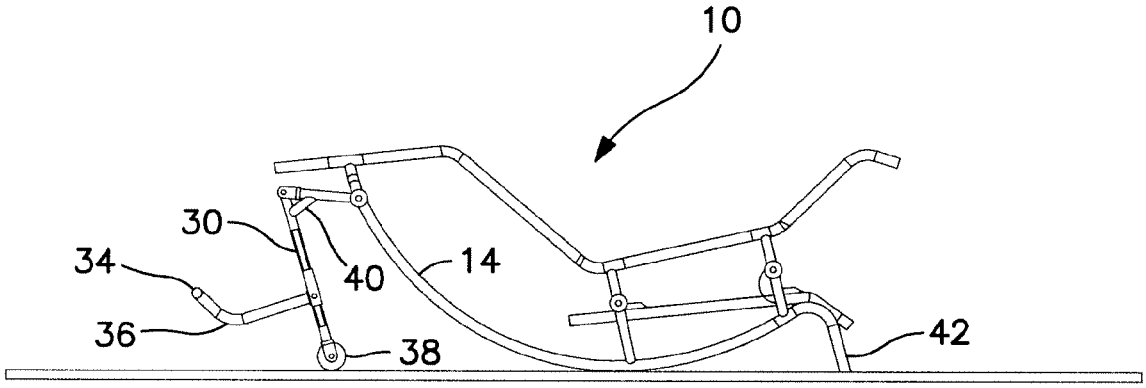
FIG. 4 is a side elevation view of the lounge shown in FIG. 1 in a reclined position.

At times, the user of lounge 10 may wish for the lounge to remain stationary. FIG. 4 illustrates the lounge secured in a stationary reclined position. Arm member 30 is pivoted back to rest against stop 40. This places runner extension 42 in contact with the floor or other supporting surface. The lounge is thus prevented from rocking in either direction. It should be noted that this configuration is particularly stable due to the fact that arm member 30 has been pivoted back beyond a vertical position to rest against stop 40 and is thus wedged in position.

Figure 5:
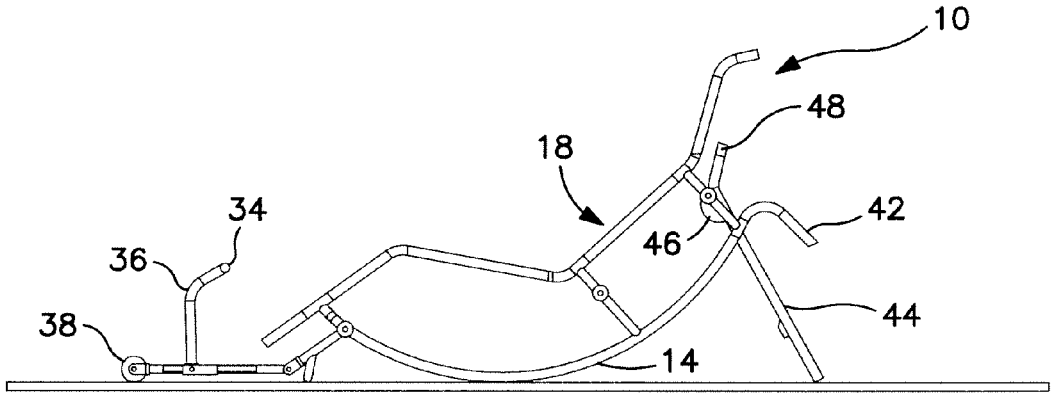
FIG. 5 is a side elevation view of the lounge shown in FIG. 1 in an upright position.

FIG. 5 illustrates lounge 10 configured in a stationary upright position. The lounge is held in this upright position by support member 44. The support member is pivotally mounted to the frame on bracket 46. A handle 48 is used to move the support member into position to retain the lounge in the upright position. Snap locks hold the support member in the stowed and open positions. A side handle (not shown) would allow the user to place the lounge in the upright position without leaving the supporting surface 18 by allowing the lounge to rock forward and then using the side handle to rotate support member 44 into position. Support member 44 is telescopically adjustable to vary the upright position.

Figure 6:
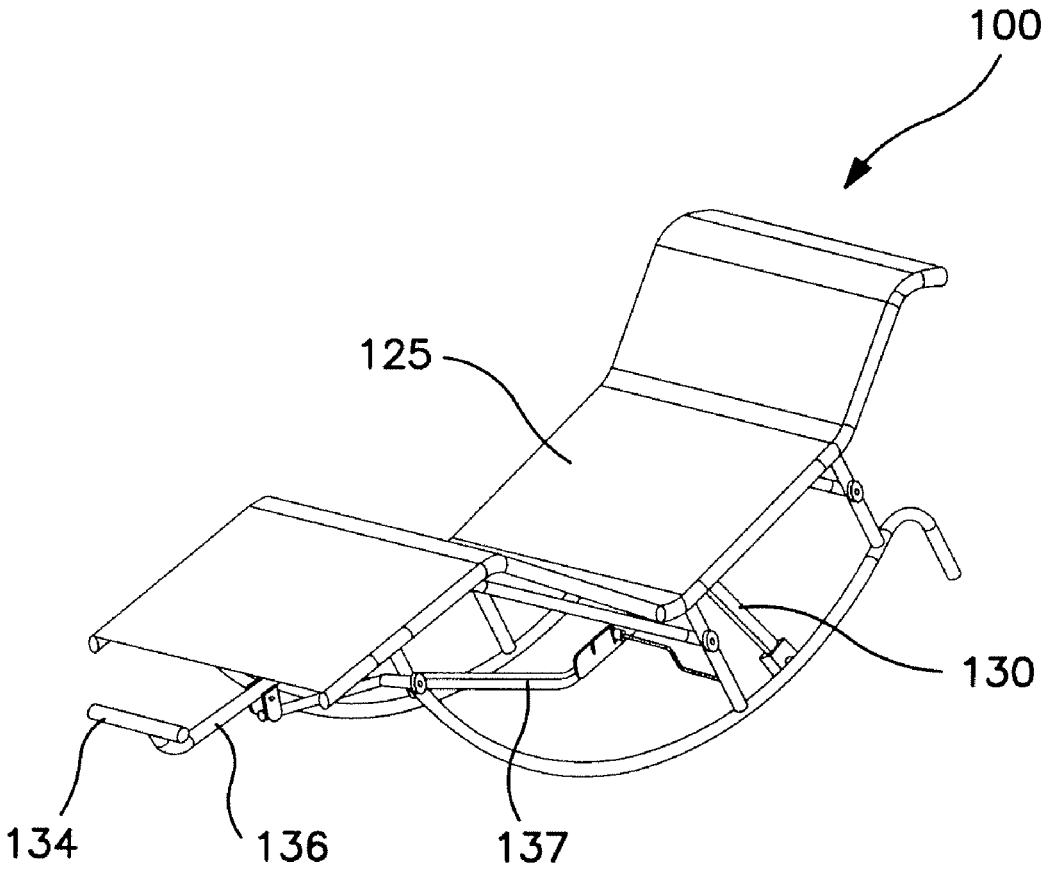
FIG. 6 is a front perspective view of a lounge in accordance with a second embodiment of the present invention.
Figure 7:
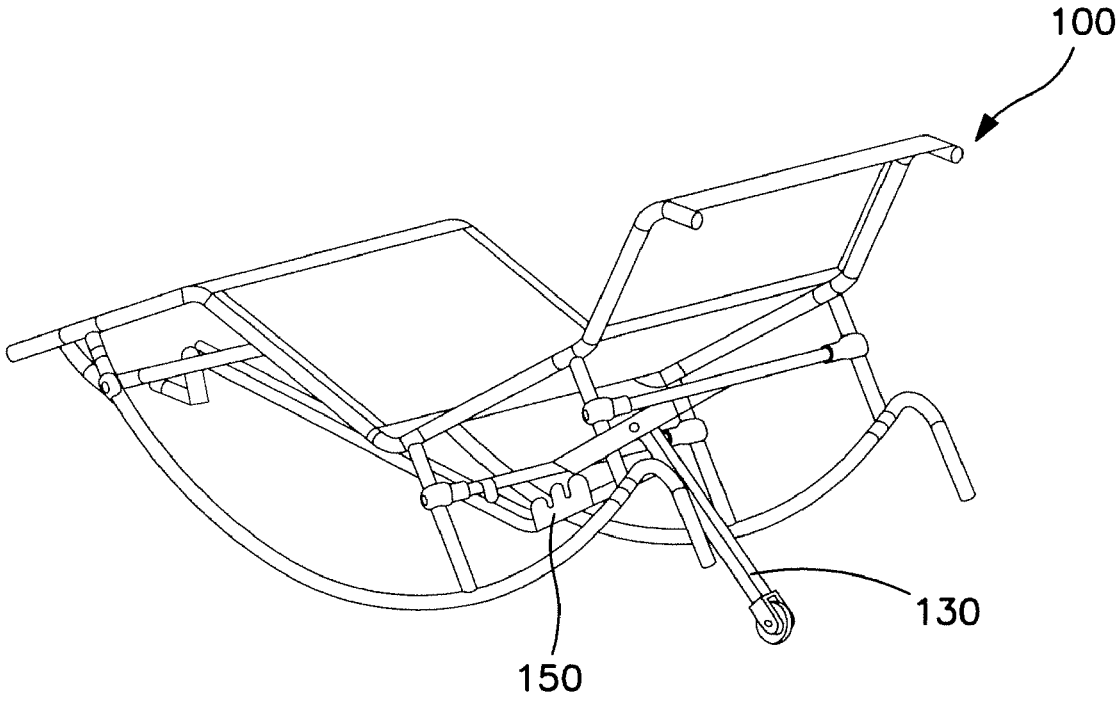
FIG. 7 is a rear perspective view of the lounge shown in FIG. 6.
Figure 8:
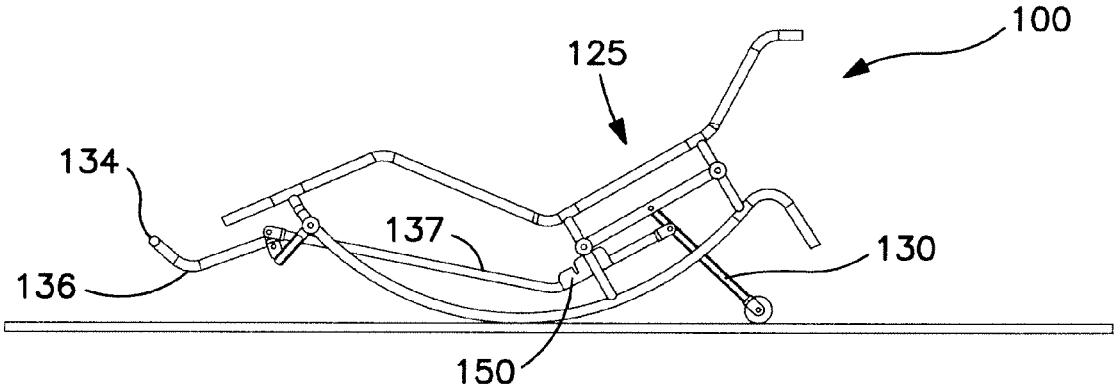
FIG. 8 is a side elevation view of the lounge shown in FIG. 6.

With reference now to FIGS. 6-8, a lounge 100 is shown in accordance with another embodiment of the present invention. Lounge 100 is generally similar to lounge 10 in overall construction, but has a modified rocking mechanism. In this embodiment, arm member 130 is pivotally attached to the frame of the lounge beneath the torso supporting portion 125. Arm member 130 is operated by foot pedal 134 through an articulated linkage assembly comprising pedal support 136 and connecting arm 137. As in the previously described embodiment, the user of lounge 100 imparts a rocking motion by pressing with his or her feet against pedal 134, which actuates arm member 130.

Figure 9:
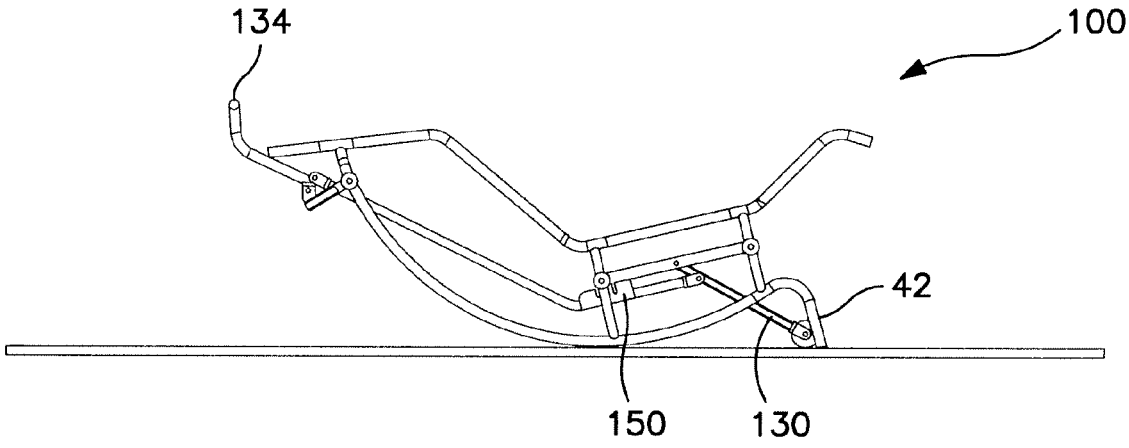
FIG. 9 is a side elevation view of the lounge shown in FIG. 6 in a reclined position.

FIG. 9 illustrates lounge 100 in a stationary reclined position. As in the previously described embodiment, lounge 100 is prevented from rocking toward a more reclined position by runner extensions 42. In this case, forward rocking motion, i.e., toward a more upright position, is prevented simply by the weight of the user whose center of gravity lies between the contact points of the runners and the runner extensions. Forward rocking motion may also be more positively prevented by an adjustable support member (similar to support member 44 of the previously described embodiment) proximate the foot end.

Figure 10:
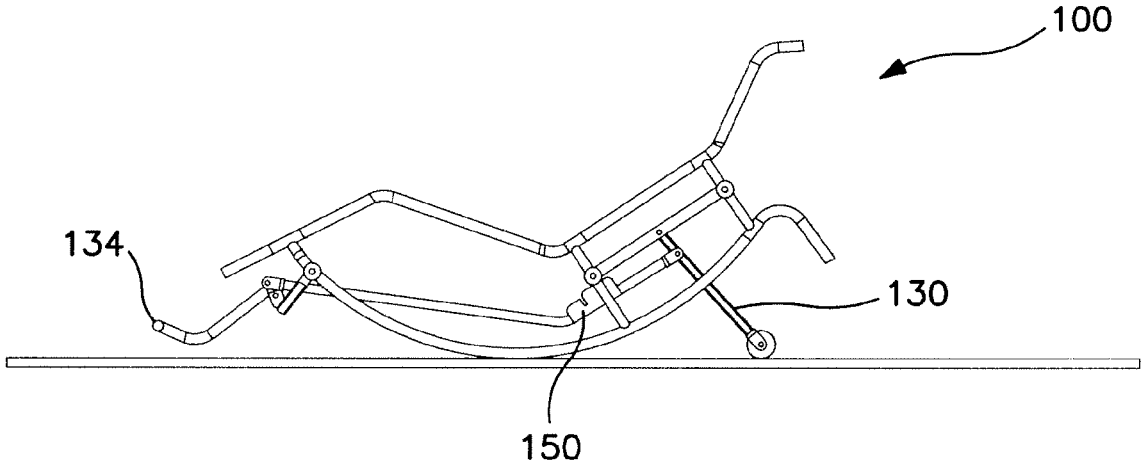
FIG. 10 is a side elevation view of the lounge shown in FIG. 6 in an upright position.

FIG. 10 illustrates lounge 100 in a stationary upright position. Arm member 130 is in a locked position as will be more fully described below. This prevents lounge 100 from rocking towards a more reclined position. Here again, the user's center of gravity lies longitudinally between the contact points of the runners and of extension arm 130, thereby effectively preventing rocking motion towards a more upright position.

Figure 11:
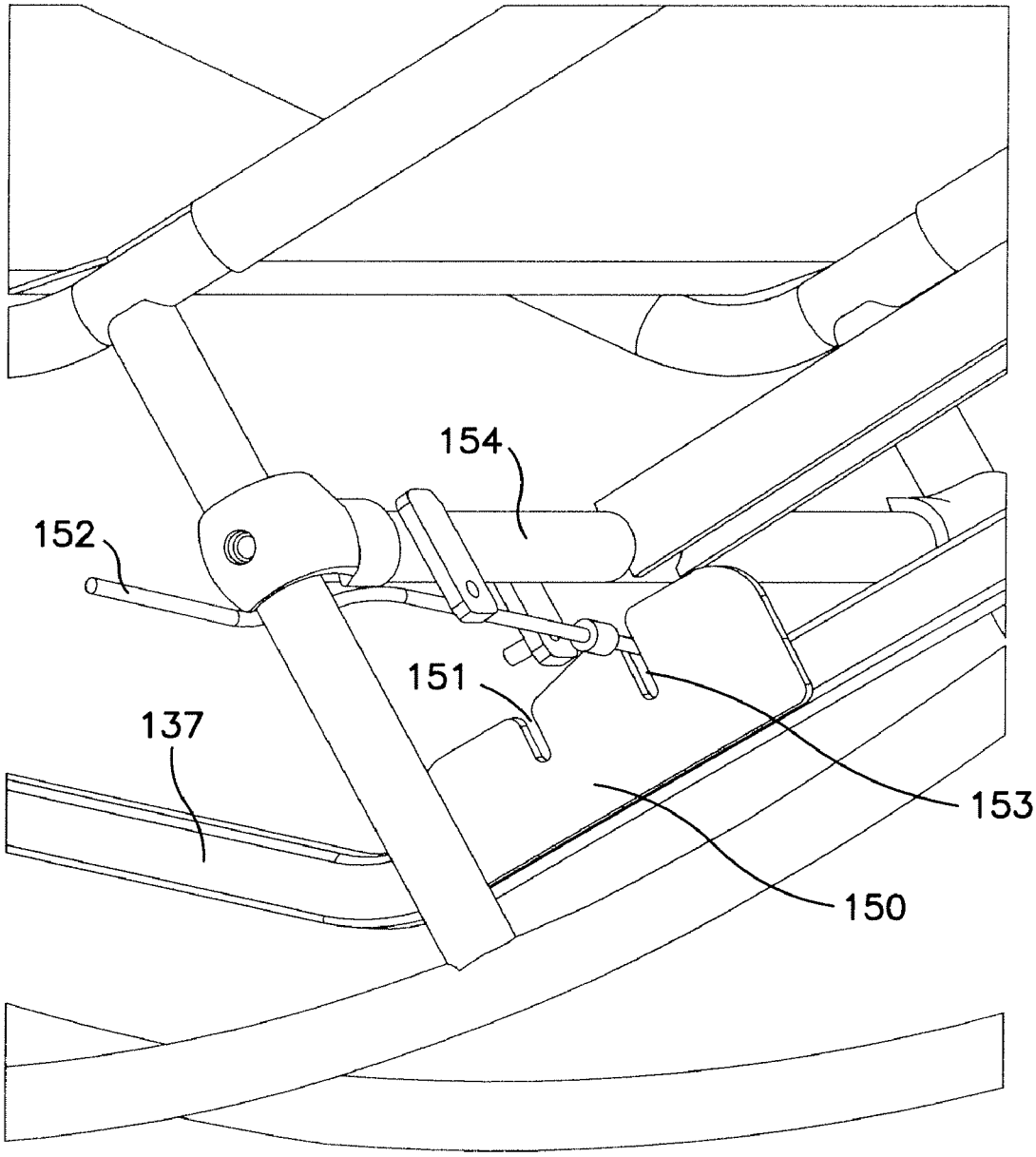
FIG. 11 is a detailed view of the latch mechanism of the lounge shown in FIG. 6.

FIG. 11 is a detailed view showing a latch assembly for securing arm member 130 in a fixed position. Latch plate 150 is secured to connecting arm 137. Latch 152 is pivotally mounted on frame cross member 154. Latch 152 may be inserted into slots 151 and 153 in plate 150. Inserting the latch into slot 151 locks arm member 130 for the reclined position of the lounge shown in FIG. 9. Inserting the latch into slot 153 locks arm member 130 for the upright position of the lounge shown in FIG. 10. There may be additional slot positions to hold the lounge in various positions.

Figure 12:
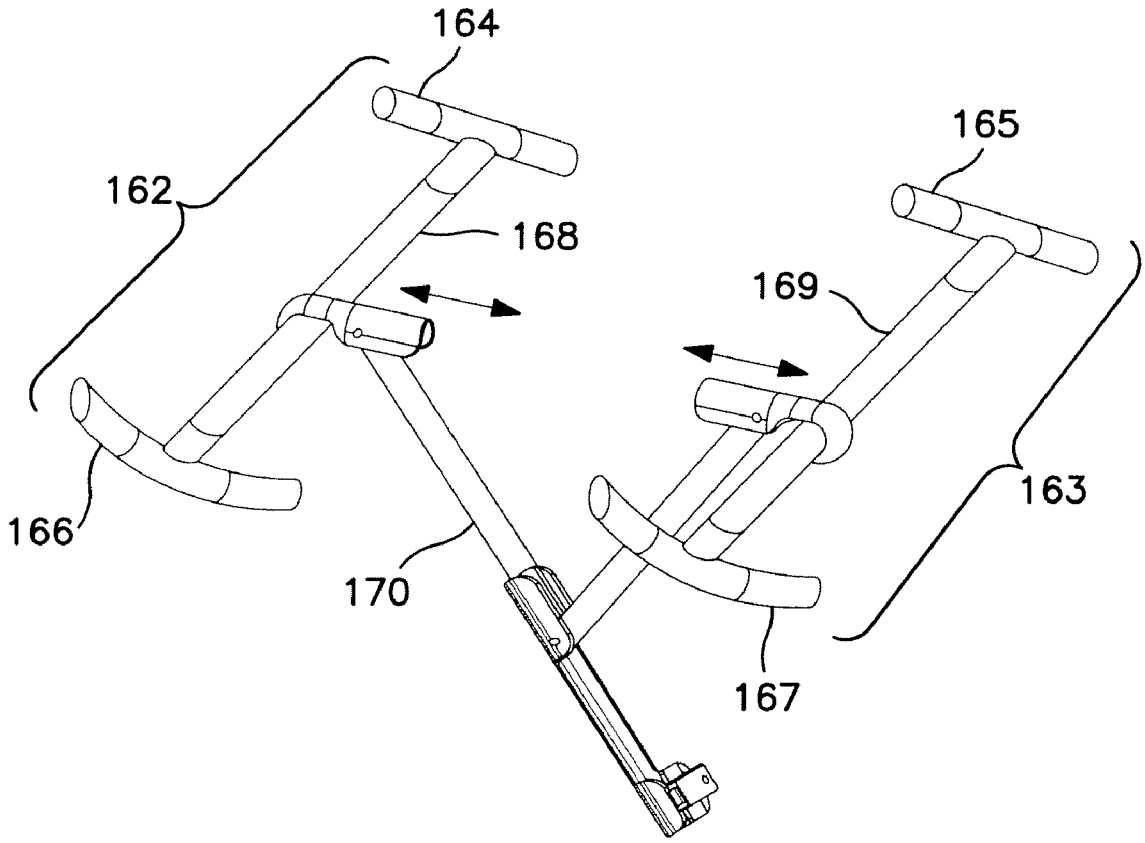
FIG. 12 is a detailed view illustrating a collapsible lounge frame.

FIG. 12 is a detailed view illustrating a lounge that may be folded for compact and convenient storage or transportation. The sides 162, 163 of the frame of the lounge comprise side rails 164, 165, arcuate runners 166, 167 and side connecting members 168, 169, respectively. Cross member 170 is connected to members 168, 169 and is hinged so that the frame may be collapsed into an essentially flat configuration with sides 162 and 163 abutting one another. It will be understood, of course, that all of the frame cross members are similarly hinged so that the lounge frame folds along its entire length.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A rocker comprising:

a frame having a pair of arcuate runners;

a user-supporting surface;

a user-operated linkage coupled to the frame for imparting a rocking motion to the rocker, wherein the user-operated linkage comprises an arm member pivotally coupled to the frame and located on a longitudinal centerline thereof, the arm member having a floor-contacting portion extending downwardly between the arcuate runners, and the user-operated linkage further comprising a foot-operated pedal coupled to the arm member;

wherein the user-operated linkage is configured to press the floor-contacting portion downwardly against a floor in response to user operation of the pedal.

2. The rocker of claim 1 further comprising a support coupled to the frame, the support configured to prevent the frame from rocking in at least one direction.

3. The rocker of claim 2 wherein the support is adjustable.

4. The rocker of claim 2 wherein the support is pivotally coupled to the frame proximate to a head end of the user-supporting surface.

5. The rocker of claim 1 wherein the user operated linkage is adjustable.

* * * * *